US005947623A

United States Patent [19]

Smith

[11] Patent Number: 5,947,623

[45] Date of Patent: Sep. 7, 1999

[54] RECOILING, REPLACEABLE CHAIN MARKING DEVICE WITH COMBINATION HOLDER AND A METHOD FOR MARKING USING SAME

[75] Inventor: Paul A. Smith, Glenview, Ill.

[73] Assignee: Eversharp Pen Co., Franklin Park, Ill.

[21] Appl. No.: 08/934,522

[22] Filed: Sep. 22, 1997

[51] Int. Cl.[6] ..... B43K 23/02

[52] U.S. Cl. ..... 401/131; 401/215; 211/69.8

[58] Field of Search ..... 401/131, 215; 211/69.1, 69.8; 242/380; 178/18

[56] References Cited

U.S. PATENT DOCUMENTS

| | | | |
|---|---|---|---|
| 245,257 | 8/1881 | Wright | 401/131 |
| D. 344,287 | 2/1994 | Johnson | 401/131 |
| 2,961,257 | 11/1960 | Carr | 211/69.8 |
| 3,387,341 | 6/1968 | Mates et al. | 401/131 |
| 5,635,682 | 6/1997 | Cherdak et al. | 178/18 |

*Primary Examiner*—Henry J. Recla
*Assistant Examiner*—Tuan Nguyen
*Attorney, Agent, or Firm*—Brian M. Mattison

[57] ABSTRACT

A retractable marking device is provided having a casing in which a coil is tightly wound from which the marking device may be extended for use thereof. A housing may further be provided such that the casing is placed within the housing. The housing may be attached to a device on which the marking device is most commonly implemented. The marking device may be a pen, pencil or other writing instrument or may also be, for example, a blunt-ended instrument for use as a pointing-type device. The tightly wound coil maintains the marking device in a retracted position so that the marking device is readily available for use. In addition, the marking device is replaceable with a substitute marking device or replaceable following depletion of, for example, ink contained therein.

7 Claims, 2 Drawing Sheets

RECOILING, REPLACEABLE CHAIN MARKING DEVICE WITH COMBINATION HOLDER AND A METHOD FOR MARKING USING SAME

BACKGROUND OF THE INVENTION

The present invention generally relates to a marking device. More specifically, the present invention relates to a retractable marking device particularly for attachment to a computer or touch-type screen mechanism for use therewith. Further, the present invention relates to a combined marking device and holder. In addition, the present invention relates to a method for assisting of marking.

Computers, including computers with touch screens, have been used for a number of years. However, computer data is often generated that requires transposition or notes regarding the same to be written down by an individual who is working on or with the computer. Often, individuals have a notebook or some other type of note recording mechanism in which to jot down notes regarding that viewed on the screen or the like. Likewise, incoming telephone calls often require quick messages to be recorded or other notes taken while an individual is using a computer. However, this is often problematic as many desks are often cluttered, and a manner for recording such notes or messages can be difficult without the necessary equipment, such as paper, pens, pencils or the like, readily available.

Still further, it is known to provide touch screens to input information or data to a computer. This is particularly common in the restaurant industry wherein orders can be placed on a touch screen and subsequently sent to a kitchen for preparation of the order. Then, after the meal is completed, all items that have been consumed or otherwise purchased can be entered via the touch screen of the computer. Often, however, a marking device other than a user's finger is more convenient or less cumbersome to use in order to enter the data via a touch screen. However, a device readily available for use in assisting entry or marking of the screen is presently not available.

Moreover, it is often necessary for handicapped individuals, such as those individuals subjected to confinement in a wheelchair, to have ready access to a marking device, such as a pen. Such availability allows the handicapped individual to recognize the location and availability of a marking device when the same is necessary for use.

A need, therefore, exists for an improved marking device and combination marking device and mounted casing as well as a method for assisting in marking to overcome the deficiencies of that which is presently available and/or implemented.

SUMMARY OF THE INVENTION

The present invention provides a marking device and a combination marking device and mounted casing as well as a method for assisting of marking. The marking device includes a wound retractable coil that at one end is attached to an instrument capable of marking such that the instrument may be extended a distance from the casing for use of the same.

To this end, in an embodiment, a retractable marking device is provided. The device has a casing with a wound retractable coil therein wherein one end of the coil is incorporated in the casing and an opposite end of the coil extends exterior to the casing. An instrument has a length defined between a first end and a second end wherein the first end is attached to the opposite end of the coil and the second end has a tip capable of producing a mark.

In an embodiment, a chain has a first end and a second end wherein the first end of the chain is attachable to the opposite end of the coil and the second end of the chain is attachable to the first end of the instrument.

In an embodiment, the tip receives ink from the instrument.

In an embodiment, the tip is rubber silicone.

In an embodiment, fastening means is connected to the casing. The fastening means may include an adhesive and/or hook and loop fasteners.

In an embodiment, a housing has an interior wherein the casing is receivable in the interior of the housing.

In an embodiment, fastening means is connected to the housing.

In an embodiment, a clip is associated with the housing wherein the instrument is receivable in the clip to secure the clip to the housing.

In an embodiment, an opening exists in the housing wherein the instrument and the coil are extendable from the casing through the opening.

In another embodiment of the present invention, a mounted casing and marking device are provided. The mounted casing and marking device comprise, in combination, an instrument having a first end and a marking end defining a length therebetween; and a housing having a wound coil therein wherein the wound coil holds the instrument with tension toward an opening in the housing from which the coil is extendable.

In an embodiment, a fastening means is associated with the housing. The fastening means may include an adhesive.

In an embodiment, a chain has a first end and a second end wherein the first end is attached to an end of the wound coil and the second end is attached to the instrument.

In an embodiment, a clip is associated with the housing through which the instrument may be secured.

In an embodiment, the marking end is capable of leaving a mark due to pressure applied to the instrument.

In an embodiment, a second opening is associated with the housing through which the instrument extends wherein the wound coil originates on one side of the second opening and is extendable to an opposite side of the second opening.

In an embodiment, the wound coil is constructed from steel wire.

In another embodiment of the present invention, a method is provided for assisting of marking. The method comprises the steps of: providing an instrument having a marking end; providing a housing having an interior with a wound coil in the interior of the housing wherein the instrument attaches to one end of the coil; extending the instrument a defined distance from the housing wherein the distance is limited by a length of the wound coil; and creating a mark with the marking end of the writing instrument.

In an embodiment, a fastener is provided for attachment of the housing to a device and attaching the housing to the device.

In an embodiment, the device is a computer or related peripheral device.

In an embodiment, the device is a wheelchair.

In an embodiment, the marking end is formed from rubber silicone.

It is, therefore, an advantage of the present invention to provide a marking device, combination marking device and casing and a method for assisting of marking that readily provides an instrument that is capable of immediate use for marking.

Another advantage of the present invention is to provide a marking device, a combination casing and marking device, and a method for assisting of marking wherein an instrument is retractably held adjacent the casing or housing from which the instrument extends.

Yet another advantage of the present invention is to provide a marking device, a combination casing and marking device and a method for assisting of marking wherein the instrument used for marking is replaceable.

A still further advantage of the present invention is to provide a marking device, a combination casing and marking device, and a method for assisting of marking that is easy to implement in various applications.

Further, an advantage of the present invention is to provide a marking device, a combination casing and marking device and a method for assisting of marking that incorporates an instrument having a blunt end for use with a touch screen of a computer.

Moreover, an advantage of the present invention is to provide a marking device, a combination mounted casing and marking device, and a method for assisting of marking that may be incorporated into various different and distinct environments.

Additional features and advantages of the present invention are described in, and will be apparent from, the detailed description of the presently preferred embodiments and from the drawings.

DETAILED DESCRIPTION OF THE PRESENTLY PREFERRED EMBODIMENTS

The present invention provides a marking device that is extendable from a casing. The marking device extends from a coil tightly wound within the casing such that the marking device may extend from the casing a distance equal to the length of coil within the casing. A housing may also be provided into which the marking device may be held. Alternatively, the housing and casing may be formed as an integrally formed unit.

Figures 1, 2:
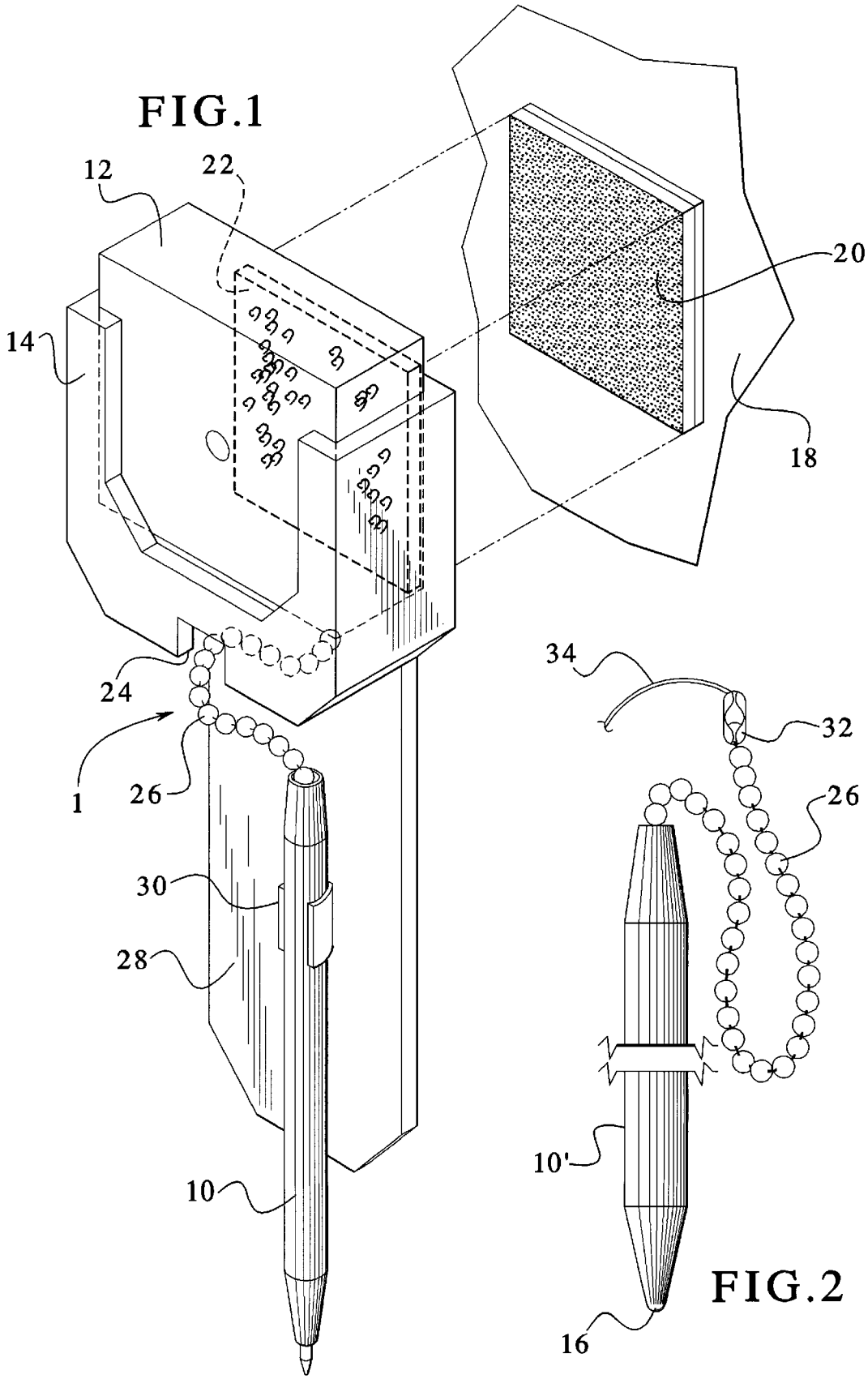
FIG. 1 illustrates a perspective view partially exploded of an embodiment of a marking device extending from a casing within an embodiment of a housing of the present invention.
FIG. 2 illustrates a plan view of an embodiment of another marking device of the present invention.

Referring now to the drawings wherein like numerals refer to like parts, FIG. 1 generally illustrates a system 1 of the present invention. The system 1 includes a marking device 10 extending from a casing 12. The casing 12 is mounted within a housing 14. As shown, the marking device 10 is a pen or other type of writing mechanism. However, the marking device 10 may also be an instrument such as generally illustrated in FIG. 2. The marking device 10' illustrated in FIG. 2 is blunt-ended having a tip 16, preferably made from rubber silicone. Such a device is particularly useful for implementations requiring input of data or the like onto a touch screen of a computer, for example.

As illustrated in FIG. 1, the housing 14 is attachable to a wall 18 of a device, such as a computer, a computer monitor, an arm of a wheelchair, a dashboard, or any other like flat surface. To this end, a number of adhesive or fastening type devices may be implemented. As shown in FIG. 1, a hook and loop fastening means are shown wherein the loop surface 20 is secured to the wall 18 and the hook surface 22 is secured to a back wall of the housing 14. Of course, this arrangement of the surfaces 20,22 may be reversed. As a result, the housing 14 may be removed from the wall 18. Of course, the hook and loop fastening surfaces 20,22 may be replaced by any other known fastening means, such as adhesive strips for permanent attachment to a wall, screws, nails, clips, or the like may also be used to fasten the housing 14 or the casing 12 directly.

As further illustrated in FIG. 1, the housing 14 receives the casing 12 within an interior space such that the casing 12 is at least partially secured within the space. An opening 24 is provided at a base of the housing 14 such that the marking device 10 may extend therethrough. The marking device 10 may also be connected via a linked chain 26 to ease replaceability of the marking device after, for example, ink has been depleted from the marking device 10. Further, the housing 14 may include an integrally formed back wall 28 on which a clip 30 may be provided for securing the marking device adjacent the back wall 28 of the housing 14.

As previously mentioned with respect to FIG. 2, an alternate marking device 10' is illustrated having a blunt or non-writing end. The marking device 10' is connected to a conventional linked chain 26 having a link 32 at its end allowing removeability and replaceability of the chain 26. The link 32 is connected to one end of a coil 34 that extends from an interior of the casing 12 which will be more clearly described and illustrated with reference to FIG. 3.

Figure 3:
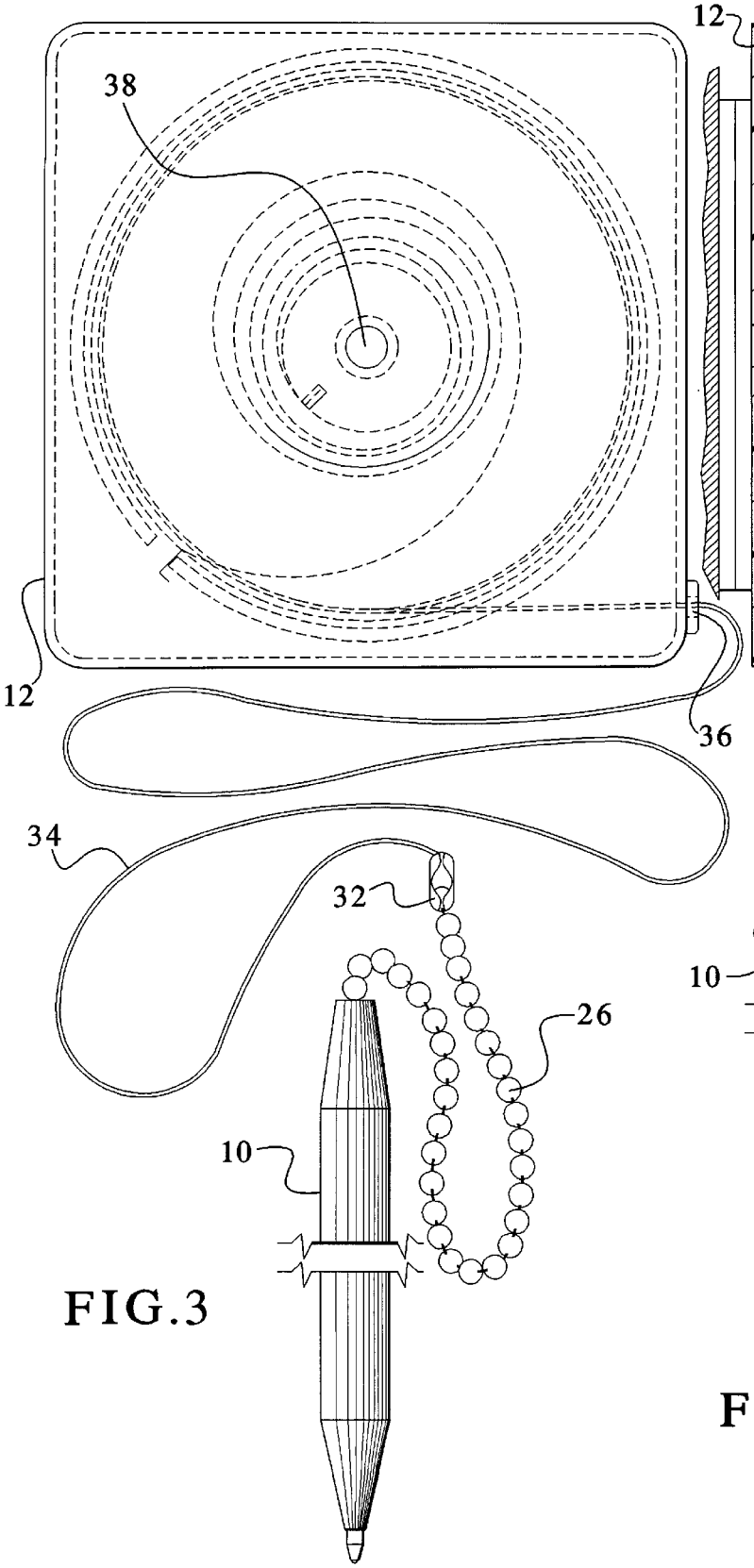
FIG. 3 illustrates a plan view of an embodiment of a marking device extending from a casing of the present invention.
Figure 4:
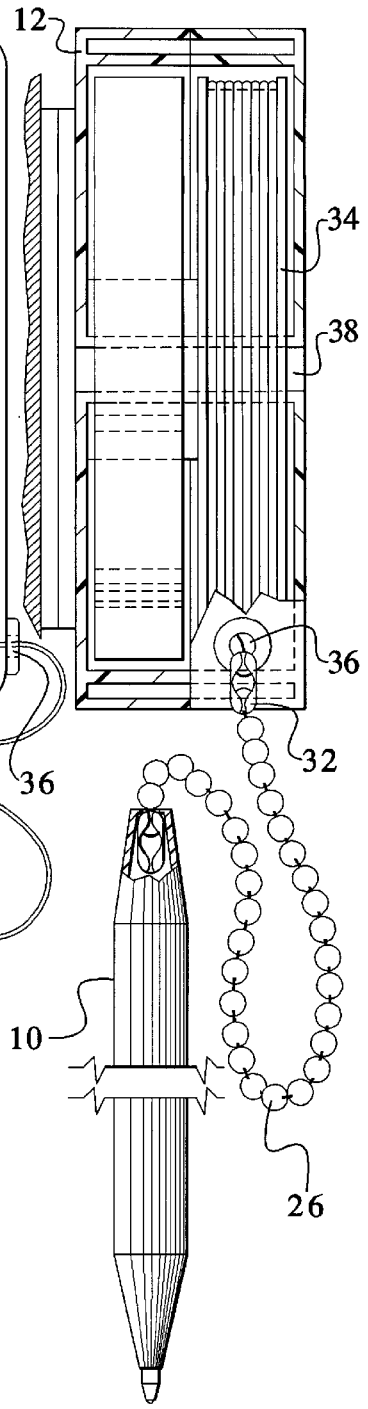
FIG. 4 illustrates a side view, partially in cross-section, of an embodiment of a marking device extending from a casing of the present invention.

Referring now to FIGS. 3 and 4, the marking device 10 is shown extending from the casing 12 with the coil 34 pulled from an opening 36 allowing the coil 34 to be released from the casing 12. Preferably, the coil 34 is made from stainless steel and is tightly wound within the casing 12 as generally illustrated in FIG. 3. As a result, in a resting position, the coil 34 is maintained entirely within the casing 12, and the link 32 is designed such that the diameter is greater than the opening 36 from the casing 12 through which the coil 34 extends. As a result, the linked chain 26 starting from the link 32 as generally shown in FIG. 4 with the marking device 10 attached thereto in its resting position does not enter the casing 12. As previously mentioned, the coil 34 is tightly wound within the casing 12 about an axis 38. Preferably, the wound coil 34 is designed such that constant resistive force is applied to the marking device 10 such that the linked chain 26 is resistively held in the position illustrated in FIG. 4 with the link 32 forced against the opening 36 of the casing 12.

It should be understood that various changes and modifications to the presently preferred embodiments described herein will be apparent to those skilled in the art. Such changes and modifications may be made without departing from the spirit and scope of the present invention and without diminishing its attendant and modifications be covered by the appended claims.

I claim:

1. A retractable marking device comprising:

a casing having a wound retractable coil therein wherein one end of the coil is incorporated in the casing and an opposite end of the coil extends exterior to the casing;

an instrument having a length defined between a first end and a second end wherein the first end is attached to the opposite end of the coil and the second end has a tip; and a housing having an opening wherein the instruments and and the coil are extendable from the casing through the opening and an interior wherein the casing is receivable in the interior of the housing wherein the casing has exterior walls having dimensions substantially equal to the interior of the housing for slidably receiving the casing in the interior of the housing.

2. The device of claim 1 further comprising:

a chain having a first end and a second end wherein the first end of the chain is attachable to the opposite end of the coil and the second end of the chain is attachable to the first end of the instrument.

3. The device of claim 1 wherein the tip receives ink from the instrument.

4. The device of claim 1 wherein the tip is rubber silicone.

5. The device of claim 1 wherein the fasting means includes hook and loop fasteners.

6. The device of claim 1 further comprising: fastening means connected to the housing.

7. The device of claim 1 further comprising:

a clip associated with the housing wherein the instrument is receivable in the clip to secure the clip to the housing.

* * * * *